US009693635B1

(12) United States Patent
Chen

(10) Patent No.: US 9,693,635 B1
(45) Date of Patent: Jul. 4, 2017

(54) COMBINATION BACK CUSHION AND FRONT CUSHION WITH A CONNECTING MEMBER HAVING AN OPENING TO REMOVABLY RECEIVE A SUPPORT MEMBER INTO THE INTERIOR REAR OF THE BACK CUSHION

(71) Applicant: Kenneth Chen, Pacific Palisades, CA (US)

(72) Inventor: Kenneth Chen, Pacific Palisades, CA (US)

(73) Assignee: Minson Corporation, Montebello, CA (US)

( * ) Notice: Subject to any disclaimer, the term of this patent is extended or adjusted under 35 U.S.C. 154(b) by 0 days.

(21) Appl. No.: 14/983,346

(22) Filed: Dec. 29, 2015

(51) Int. Cl.

| | |
|---|---|
| ***A47C 7/02*** | (2006.01) |
| ***A47C 7/18*** | (2006.01) |
| ***A47C 7/40*** | (2006.01) |
| ***A47C 7/42*** | (2006.01) |
| ***A47C 3/00*** | (2006.01) |

(52) U.S. Cl.
CPC ..... *A47C 7/185* (2013.01); *A47C 3/00* (2013.01); *A47C 7/40* (2013.01)

(58) Field of Classification Search
CPC ..... A47C 7/185; A47C 3/00; A47C 7/40
USPC ..... 297/230.1, 230.11, 230.12, 230.13, 297/230.14, 440.2, 440.21, 452.57
See application file for complete search history.

(56) References Cited

U.S. PATENT DOCUMENTS

| | | | | |
|---|---|---|---|---|
| 860,632 | A | 7/1907 | Breithut | |
| 873,265 | A | 12/1907 | Petroskey | |
| 1,711,959 | A | 5/1929 | Morin | |
| 2,169,197 | A | 8/1939 | Reed | |
| 2,186,301 | A | 1/1940 | La More | |
| 2,265,901 | A | 12/1941 | Greig | |
| 2,659,420 | A * | 11/1953 | Burke | B60N 2/7005 297/230.1 X |
| 2,756,808 | A * | 7/1956 | Eichorst | A47C 7/425 297/230.11 |
| 2,792,875 | A * | 5/1957 | Pirrone | A47C 1/16 297/130 |
| 2,835,311 | A * | 5/1958 | Reeves | B60N 2/4879 297/230.11 |
| 2,837,144 | A * | 6/1958 | Heller | A47C 7/20 297/218.1 |
| 2,960,152 | A | 11/1960 | Wendel | |
| 3,336,078 | A * | 8/1967 | Haley | B60N 2/3097 297/440.21 X |
| 3,896,531 | A | 7/1975 | Gorman | |

(Continued)

*Primary Examiner* — Rodney B White
(74) *Attorney, Agent, or Firm* — Thomas I. Rozsa

(57) ABSTRACT

A combination back cushion and seat cushion which are retained together by a retaining member which is preferably a flap member which is affixed to the rear of the seat cushion and also affixed to the rear of the back cushion, the connecting member having an opening to removably receive a steel support within the back cushion, which steel support is inserted behind any cushioning member of the back seat so that when the steel support frame is completely inserted into the back frame, the back cushion is rotated relative to the front cushion so that the support member within the back cushion is completely concealed but still provides the required extra support for a person to rest their back against the back cushion.

7 Claims, 8 Drawing Sheets

(56) References Cited

U.S. PATENT DOCUMENTS 3,995,893 A * 12/1976 De La Taille ..... A47C 31/023 297/452.2
4,285,544 A * 8/1981 Zapf ..... A47C 3/16 297/440.21 X
4,365,840 A 12/1982 Kehl et al.
4,367,897 A 1/1983 Cousins
4,385,783 A * 5/1983 Stephens ..... A47C 1/03 297/452.57 X
4,722,569 A * 2/1988 Morgenstern ..... A47C 7/462 297/230.14
4,746,168 A 5/1988 Bracesco
4,755,000 A * 7/1988 Chiaro ..... A47C 31/02 297/440.15
4,815,789 A 3/1989 Marcus
4,828,320 A 5/1989 Saiger
4,844,541 A * 7/1989 Laird ..... A47C 3/0252 297/440.21 X
5,000,512 A * 3/1991 Laird ..... A47C 4/028 297/440.2 X
5,112,110 A * 5/1992 Perkins ..... A47C 4/028 297/440.21 X
5,316,375 A 5/1994 Breen
5,609,395 A * 3/1997 Burch ..... A47C 7/42 297/335
5,882,079 A * 3/1999 Yang ..... A47C 1/146 297/228.1
5,931,538 A 8/1999 Cayet et al.
6,491,345 B1 12/2002 Shepard
6,729,691 B2 5/2004 Koepke
6,752,464 B1 6/2004 Tseng
7,104,605 B2 * 9/2006 Jones ..... A47C 1/16 297/230.11
7,108,330 B2 * 9/2006 Mizelle ..... A47C 4/06 297/452.57 X
7,270,377 B2 * 9/2007 Schmitz ..... A47C 7/425 297/230.1
7,313,836 B1 * 1/2008 Swezey ..... A47C 20/027 297/230.1
7,708,345 B2 5/2010 Grabowski et al.
8,061,771 B2 11/2011 Goeckel
8,366,044 B2 2/2013 Marini
8,991,930 B2 * 3/2015 Laframboise ..... B29C 44/12 297/440.2
2010/0140995 A1 * 6/2010 Everett ..... A47C 4/54 297/230.1

* cited by examiner

COMBINATION BACK CUSHION AND FRONT CUSHION WITH A CONNECTING MEMBER HAVING AN OPENING TO REMOVABLY RECEIVE A SUPPORT MEMBER INTO THE INTERIOR REAR OF THE BACK CUSHION

BACKGROUND OF THE INVENTION

1. Field of the Invention

The present invention relates to the field of furniture and in particular, chairs that have a backrest for added comfort when a user is seated in the chair.

2. Description of the Prior Art

The inventor is aware of the following prior art patents and published patent applications of which the inventor became aware during the prosecution of a previously filed patent application Ser. No. 13/947,007. The following 15 patents and published patent applications are relevant to the present invention:

1. U.S. Pat. No. 2,169,197 issued to Clair S. Reed on Aug. 8, 1939 for "Seat Structure" (hereafter the "Reed Patent");
2. U.S. Pat. No. 2,186,301 issued to Harold C. La More on Jan. 9, 1940 for "Upholstered Seat Beat Structure" (hereafter the "La More Patent");
3. U.S. Pat. No. 2,265,901 issued to James W. Greig on Dec. 9, 1941 for "Seat Structure For Vehicles" (hereafter the "Greig Patent");
4. U.S. Pat. No. 3,896,531 issued to DeWitt Y. Gorman on Jul. 29, 1975 for "Upholstery System Method And Apparatus" (hereafter the "Gorman Patent");
5. U.S. Pat. No. 4,815,789 issued to Fred Marcus on Mar. 28, 1989 for "Chair Kit" (hereafter the "Marcus Patent");
6. U.S. Pat. No. 4,828,320 issued to Herbert C. Saiger on May 9, 1989 for "Chair Frame And Cushion Assembly" (hereafter the "Saiger Patent");
7. U.S. Pat. No. 5,316,375 issued to William R. Breen on May 31, 1994 for "Back Support And Internal Frame" (hereafter the "Breen Patent");
8. U.S. Pat. No. 5,931,538 issued to Alain Cayet at al. on Aug. 3, 1999 for "Vehicle Seat Element Including A Cover Tensioned Over A Metal Frame" ("hereafter the "Cayet Patent");
9. U.S. Pat. No. 6,726,691 issued to Marcus C. Koepke et al. on May 4, 2004 for "Chair Back Construction" (hereafter the "Koepke Patent");
10. U.S. Pat. No. 6,752,464 issued to Chuen-Jong Tseng on Jun. 22, 2004 for "Modular Furniture Frame" (hereafter the "Tseng Patent");
11. U.S. Pat. No. 7,708,345 issued to Daniel Grabowski et al. on May 4, 2010 for "Recliner" (hereafter the "Grabowski Patent");
12. U.S. Pat. No. 8,061,771 issued to Gregory W. Goeckel on Nov. 22, 2011 for "Supportive Back Overlay For Wheelchair Back" (hereafter the "Goeckel Patent");
13. U.S. Pat. No. 8,366,044 issued to Hector Noel Marini on Feb. 5, 2013 for "Removable Back Shell For An Aircraft Seat" (hereafter the "Marini Patent");
14. U.S. Pat. No. 6,491,345 issued to Shepard on Dec. 10, 2002 for "Seat Having Interchangeable Inserts" (hereafter the "Shepard Patent");
15. Scheurer et al. Published Patent Application 2010/0019558 published on Jan. 28, 2010 for "Buoyant Pool Chair With Sealed Frame" (hereafter "Scheurer Publication").

The Marcus Patent discloses the following relevant pieces of information:

"The present invention is directed to assemblies and sub-assemblies for incorporation into a chair, to a chair kit that comprises these assemblies and sub-assemblies, and to the chair itself. It includes a substantially rectangular seat and back cushion sub-assemblies for incorporation into a chair. The seat and back cushion sub-assemblies may be readily removed from and replaced onto the chair itself, thereby facilitating the replacement of a rigidifying inner foam pad. The invention also includes a novel means of securing cushions to the chairs. This means comprises a rigid, substantially rectangular seat frame member having laterally opposed slots along its inner portion. At least one fixedly secured and at least one movably secured screw-receiving leg is attached to this seat frame member."

The Cayet Patent is for a vehicle seat element including a cover tensioned over a metal frame. The patent discloses:

"A vehicle seat element is covered by a cover having four lateral panels which are folded over a rigid frame. Two of the lateral panels that are opposite each other, present in the vicinity of their free edges buttonholes which are engaged on tabs that are free from sharp edges and that are secured to the rigid frame. An inextensible flexible cord is stitched along the free edges of the cover, between said free edges and the corresponding buttonholes."

The Koepke Patent discloses a chair construction which has the metal frame incorporated into the chair. Specifically, the patent discloses:

"A chair back is disclosed and includes a mesh material connected to a two-piece carrier, the carrier being deformable and stretchable. The carrier has a bottom edge including a groove and is engageable by tabs attached to a transverse member of a chair frame assembly. The upper ends of the carrier each includes an opening for receiving a spherical end portion of the upper end of the chair frame assembly. Engagement of the carrier with the chair frame assembly is accomplished by stretching the carrier and mesh between the transverse member and the spherical end portions. The chair back includes a lumbar support which is mounted to slide along the side edges of the carrier and along vertical supports of the chair frame assembly, the lumbar support causing the chair to tension forwardly. The chair back is pivotal under the influence of a chair user and is pivotally connected to the chair seat so as to cause the chair seat to also pivot in response."

The Grabowski Patent for a recliner discloses:

"One embodiment of the invention includes a reclining chair that includes: a chair frame comprising front and rear frame members, two parallel side frame members each side frame member attachable to the front and rear members; a seat supported by at least two frame members; a backrest; a pair of legs, wherein the frame members are connected to the legs; a first and second recliner assembly comprising a bracket, the bracket is attachable to the backrest enabling reclining movement of the backrest as the bracket moves through a correspondingly shaped bracket slot in a recliner base plate, wherein the bracket rotates about an axis that approximates the position of the rotational axis of the hip of a seated user."

The Reed Patent discloses a solid metal frame assembly built into the chair so that there is not a separate frame assembly built into the cushion.

The La More Patent discloses: improvements in the upholstered seat back structure.

The main objects of this invention are: First, to provide a back structure which is well adapted for theater and auditorium seats and the like, and one which, while attractive in appearance, permits ready removal of changing of the upholstery; Second, to provide a seat back structure of this character in which the upholstery may be very quickly applied by relatively unskilled workmen. Third, to provide a seat back structure which may be economically produced mainly of sheet metal stampings and at the same time one in which the parts are so arranged that they do not spring or buckle when made of light gage metal.

The Greig Patent discloses a seat structure for vehicles. Referring to FIG. 3, there is a spring frame assembly that is built into the back of the seat as illustrated. The patent further discloses: "In the drawings there are shown, by way of example, vehicle seat structures constructed in accordance with certain embodiments of the present invention. The structure shown therein comprises generally a back rest, the lower cushion, and means for securing the same together. The back rest and the cushion are so constructed that each of them may be manufactured separately and assembled together after each of them is completed. When assembled together the back rest and the lower cushion provide a single unit. When assembled in a vehicle, the lower cushion is not removable and it remains firmly in place.

The Gorman Patent discloses the concept of having the frame backing built into the entire chair with the cushion effectively fit over that frame backing as best illustrated in FIG. 2.

The Saiger Patent discloses a chair frame and cushion assembly. The frame member is built into the chair itself and not into the separate cushion.

The Breen Patent discloses a back support and internal frame. Specifically, the patent discloses: "There is provided a frame for use with a back support that provides lateral support to an individual while seated to encourage a correct sitting posture, and that also provides lumbar support to the individual that varies according to the individual's size. The frame includes wing portions that act as lateral supports and as torsion bars to cause the center portion of the frame to become convex to support the lumbar region of an individual resting against the back support incorporating the frame. The frame can be incorporated into a portable support unit or to a support unit that is an integral part of a chair."

The Tseng discloses a framework for a chair. It further discloses that the seat frame unit includes a parallel pair of upright side frame parts, each of which has front and rear ends opposite to each other in a first direction. The side frame parts are spaced apart from each other in a second direction transverse to the first direction. The seat frame unit further includes a pair of rear coupling members that are connected to the rear ends of the side frame parts, a pair of front coupling members that are mounted on the front ends of the side frame parts, a pair of mounting members that are mounted on the front coupling members, and a bracing rod. The rear coupling members are used to mount the backrest frame unit on the seat frame unit, whereas the mounting members on the front coupling members are used to mount the leg cushion on the seat frame unit.

The Goeckel Patent discloses a supportive backrest attachment for a wheelchair. The patent discloses: "A supportive back rest for attachment to an original equipment back rest of a wheelchair to enhance the supportive characteristics of the wheelchair back rest. The supportive back rest includes a cushion, a suspension element and a cover. The cushion and one side of the suspension element are positioned in the cover. An opposed side of the suspension element is exposed and defines a space between it and the cushion. The suspension element slips over the upper edge of the original equipment back rest of the wheelchair to suspend the supportive back rest in position behind a seated user. The suspension element can be attached to the cover or can be attached to the cushion by molding or through attachment anchors."

The Marini Patent discloses the concept of having the metal portion incorporated into the chair and thereafter the cushion on top of it.

The Shepard Patent is essentially a chair which has a reinforcing section in the seat and also a separate reinforcing section in the backrest. In each case, the reinforcing section is fully exposed and is not contained within any portion of a cushion or any other seating member placed on the seat or against the back of the chair.

The Scheurer Publication discloses a buoyant seat which is formed of overlapping layers of buoyant cushion material. Each buoyant cushion is formed by a pair of overlapping layers of buoyant material, preferably closed slabs of cell polyurethane foam having a given density.

The above described patents and published applications do not disclose or reveal the present invention. Further, during the prosecution of a prior patent application, the inventor was made aware of the following patents:

U.S. Pat. No. 860,632 issued to Breithut on Jul. 23, 1907 for "Chair Back Hinge".

U.S. Pat. No. 873,265 issued to Petroskey on Dec. 10, 1907 for "Metallic Chair".

U.S. Pat. No. 1,711,959 issued to Morin on May 7, 1929 for "Chair".

U.S. Pat. No. 2,960,152 issued to Wendel on Nov. 15, 1960 for "Blocked Furniture".

U.S. Pat. No. 3,896,531 issued to Gorman on Jul. 29, 1975 for "Upholstery System Method and Apparatus".

U.S. Pat. No. 4,365,840 issued to Kehl et al. on Dec. 28, 1982 for "Seat With Back Cushion Attachment".

U.S. Pat. No. 4,367,897 issued to Cousins on Jan. 11, 1983 for "Adjustable Seat for the Handicapped".

U.S. Pat. No. 4,746,168 issued to Bracesco on May 24, 1988 for "Motor Vehicle Seat".

U.S. Pat. No. 5,478,133 issued to Tidwell, Jr. on Dec. 26, 1995 for "Motion Furniture Construction".

U.S. Pat. No. 5,570,874 issued to Tornero on Nov. 5, 1996 for "Furniture Spring Assembly With Elastic Webbing".

United Kingdom Patent GB 2151131 issued to Hawtree et al. in July 1985.

There is a significant need for an improved backrest for a seat or other furniture item where the item includes one or more cushions against which a person places his back after the person is seated on the furniture item.

SUMMARY OF THE INVENTION

The present invention is a combination back cushion and seat cushion which are retained together by a retaining member which is preferably a flap member which is affixed to the rear of the seat cushion and also affixed to the rear of the back cushion, the connecting member having an opening to removably receive a steel support within the back cushion, which steel support is inserted behind any cushioning member of the back seat cushion so that when the steel support frame is completely inserted into the back cushion, then the back cushion is rotated relative to the front cushion so that the support member within the back cushion is completely concealed but still provides the required extra support for a person to rest their back against the back cushion.

The present invention is an internal removable concealed support frame inserted into a back cushion of a chair or other furniture item which contains cushions. The back cushion is designed so that it includes the general cushion covering of a front, back, left and right side into which foam or other soft support material is inserted. The back cushion contains a primary main chamber which contains a foam member. The foam is inserted through an opening in the bottom wall of the back cushion so that it is removably retained into the main chamber of the back cushion to provide a cushioning support to a person resting against the back cushion. An enclosure member which is a zipper encloses the main chamber within the back cushion. There is a second separate chamber within the back cushion which is either separated from the main chamber or included in the main chamber so that the present invention's steel support is retained within an alternative second separate chamber. If there can be a dividing wall between the foam cushion from the top to the bottom of the back cushion and then a second chamber which is surrounded by a portion of the top wall, the back wall, the interior dividing wall adjacent to the main chamber which is connected to the flap opening, then the present invention metal support does not come in contact with the foam. If there is no such dividing wall, the present invention support (primarily made of metal such as steel) does not come in contact with the foam. With either alternative, the back cushion has a flap member that is affixed to it which contains a front surface, a back surface and a pair of side surfaces with a bottom opening which is an open connection to the second chamber of the back cushion which retains the steel support.

The steel support is inserted through the bottom opening in the flap section and it is inserted so that the entire support is entirely within the back cushion in either a separate chamber with a dividing wall between the section of the back cushion retaining the steel support and the foam cushion or alternatively has no dividing wall so that the foam is retained in a main chamber and the steel support is retained within a second chamber and touches the foam. The flap member is also permanently affixed to a bottom cushion which may have a removable portion so that the bottom portion of the cushion may be cleaned.

Therefore, the back cushion and the seat cushion are one integral unit which are connected by the flap section. After the steel support is inserted in the opening of the flap section and the aligned opening in the back cushion, then the flap is rotated so that the back cushion is approximately perpendicular to the seat cushion and thereafter the combination back and seat cushion is retained on a chair so that a person can sit on the seat cushion and a person can have their back against a back cushion with the foam providing comfort support and the present invention support frame providing structural support or stability to the cushion. The cushion design of the present invention further includes a flap section extending from the lower seat cushion portion which enables access to the interior back of the back cushion wherein the present invention back support frame can be inserted.

It is therefore an object of the present invention to provide a backrest support for a back cushion which adds sufficient strength so that when a person leans against the back cushion on a chair or other furniture item, the person's back will have substantially more support than with just the soft back cushion. Therefore, the person can lean against the back cushion which provides substantially more support than a back cushion which contains only foam and no support member such as the steel frame support member of the present invention.

It is a further object of the present invention to provide a combination back and seat cushion where the back cushion and the seat cushion are retained together by a flap member and moveably connected to each other so that the back cushion can be rotated away from the seat cushion to expose an opening in a connecting flap which connects the back cushion to the seat cushion. Further, there is an opening in the connecting flap that is aligned with an opening in the back cushion through which the present invention support member can be supported. The present invention also contains a back cushion that is rotated so that the back cushion is generally perpendicular to the seat cushion with the present invention support member such as a steel support is firmly retained within either a separate chamber within the back cushion or in a portion of the back cushion adjacent the foam portion retained within the back cushion.

The flap section is affixed to a preferably rear surface of the back cushion and the seat cushion so that they are retained together where the back cushion and the seat cushion have separate foam members. These members may respectively be removably inserted in the back cushion and the seat cushion flap with the flap having an opening to permit the support member to be inserted into the bottom flap member.

The flap section of the back cushion is sewn or otherwise affixed to the bottom of the seat cushion so that they are one integral unit with the separation to facilitate the extending flap from the back cushion which enables the reinforcing metal support member to be removably inserted into the back cushion behind any foam or other soft support, which frame support to fully supports person's back to enable a person to lean heavily against the back cushion.

Defined in detail, the present invention is an addition used in conjunction with a back cushion including an exterior cover surface surrounding an interior surface housing a foam insert and an opening in a bottom of the exterior surface of the back cushion with the open leading to a vacant area within the back cushion and between a back surface of the foam and an interior surface of a back surface of the exterior cover cushion, the addition comprising: (a) a support frame member including a top frame member, a bottom frame member, a first side frame member, a second side frame member and a multiplicity of internal support members extending from the top frame member to the bottom frame member and positioned at spaced apart locations between the first side frame member and the second side frame member, and (b) the support frame member inserted into and retained in said vacant area with the interior of the back cushion, the insertion through said bottom opening in said cushion, said support frame resting against a back surface of said foam, each respective top frame member, bottom frame member, first side frame member and second side frame member respectively aligned adjacent corresponding foam top side, bottom side, first side and second side; (c) whereby said support frame member provides support against a force when a person's back rests against the back cushion.

Defined more broadly, the present invention is a combination back cushion and seat cushion which are retained together by a retaining a flap affixed to a rear surface of the back cushion and also affixed to a rear surface of the seat cushion, the back cushion having exterior walls surrounding an interior chamber retaining a foam sized to rest adjacent surfaces of the back cushion including an interior top surface, interior bottom surface, interior first sidewall surface, interior second sidewall surface and interior front surface, the foam sized to create an interior sub-chamber between a back surface of the foam and an interior back surface of the back cushion, a bottom opening in the back cushion leading to the interior sub-chamber, the retaining flap having a bottom opening aligned with said bottom opening of the interior sub-chamber, the addition comprising: (a) a support frame member including a top frame member, a bottom frame member, a first side frame member, a second side frame member and at least one internal support member extending from the top frame member to the bottom frame member and positioned between the first side frame member and the second side frame member, and (b) the support frame member inserted into and retained in said interior sub-chamber, the insertion through said opening in said flap and through said aligned opening in said sub-chamber, said support frame resting against the back surface of said foam, and sized so that said top frame member is adjacent said interior top surface, said bottom frame member is adjacent said interior bottom surface, said first frame member is adjacent said interior first sidewall surface, said second side frame member is adjacent said interior second sidewall surface; and (c) said support frame member is concealed within said back cushion when the back cushion rests adjacent the seat cushion.

Defined even more broadly, the present invention is a combination back cushion and seat cushion which are retained together by a retaining flap affixed to a rear surface of the back cushion and also affixed to a rear surface of the seat cushion, the back cushion having exterior walls surrounding an interior chamber retaining a foam, the foam sized to create an interior sub-chamber between a back surface of the foam and an interior back surface of the back cushion, a bottom opening in the back cushion leading to the interior sub-chamber, the retaining flap having a bottom opening aligned with said bottom opening of the interior sub-chamber, the addition comprising: (a) a support frame member including a top frame member, a bottom frame member, a first side frame member, a second side frame member and at least one internal support member extending from the top frame member to the bottom frame member and positioned between the first side frame member and the second side frame member, and (b) the support frame member inserted into and retained in said interior sub-chamber, the insertion through said opening in said flap and through said aligned opening in said sub-chamber, said support frame within said sub-chamber, and (c) said support frame member is concealed within said back cushion when the back cushion rests adjacent the seat cushion.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE EMBODIMENTS OF THE INVENTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
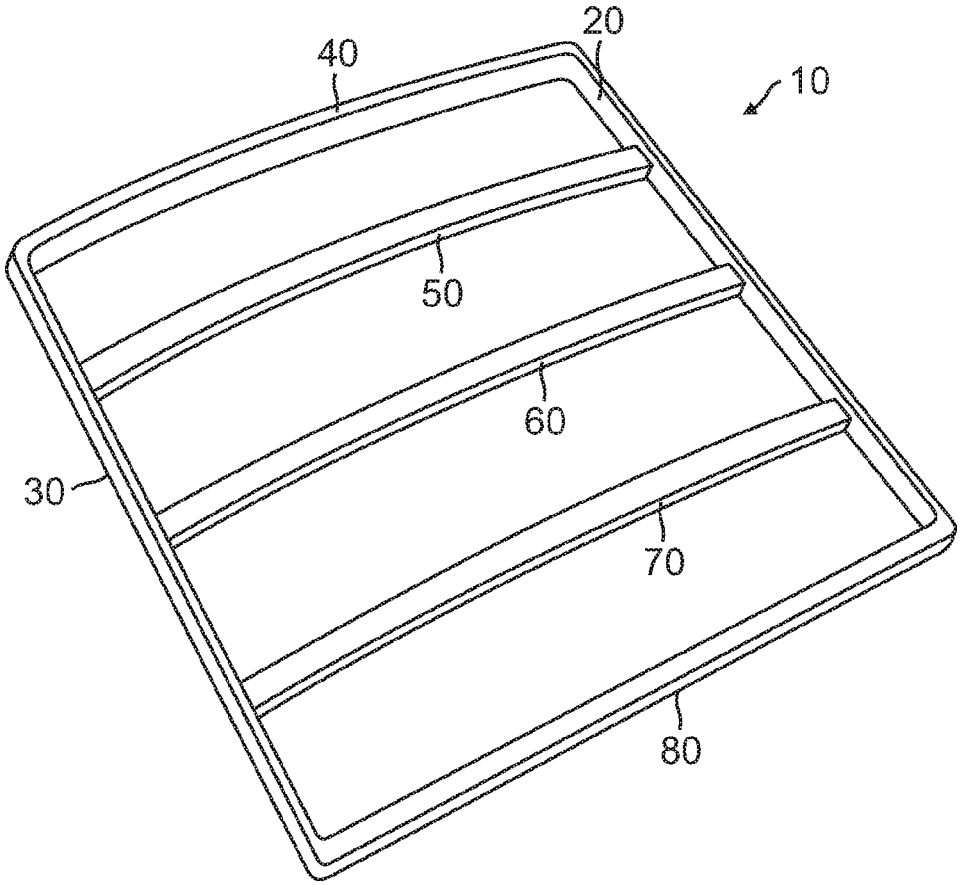
FIG. 1 is a perspective view of the present invention steel frame member which is insertable into the back cushion to provide additional support for the back cushion.

Referring to FIG. 1, there is illustrated a perspective view of the support member of the present invention. The support member can be made of any strong material but is preferably made of steel or any variations of steel such as stainless steel, or any other strong metal such as aluminum but can also be made of strong synthetic material such as polycarbonate or polyvinyl which has been formed into the shape as set forth in FIG. 1.

The support member which preferably is a steel support member 10 is comprised of a top frame member 20 and a bottom frame number 30, a first or left side frame member 40 and a second or right side frame member 80. There are a multiplicity of internal support members extending from the top frame member 20 to the bottom frame member 30. Illustrated in FIG. 1 is an embodiment which has three internal support members or support ribs which include a first or leftmost support rib 50, middle support rib 60 and third or rightmost support rib 70. The orientation of right and left is best illustrated from the view of the invention in FIG. 2. It will be appreciated that any number of support ribs as illustrated numbers 50, 60, and 70 are within the spirit and scope of the present invention. There needs to be at least one internal support rib and preferably two internal support ribs but any multiplicity of support ribs such as 4, 5, 6 etc. are within the spirit and scope of the present invention.

Figure 2:
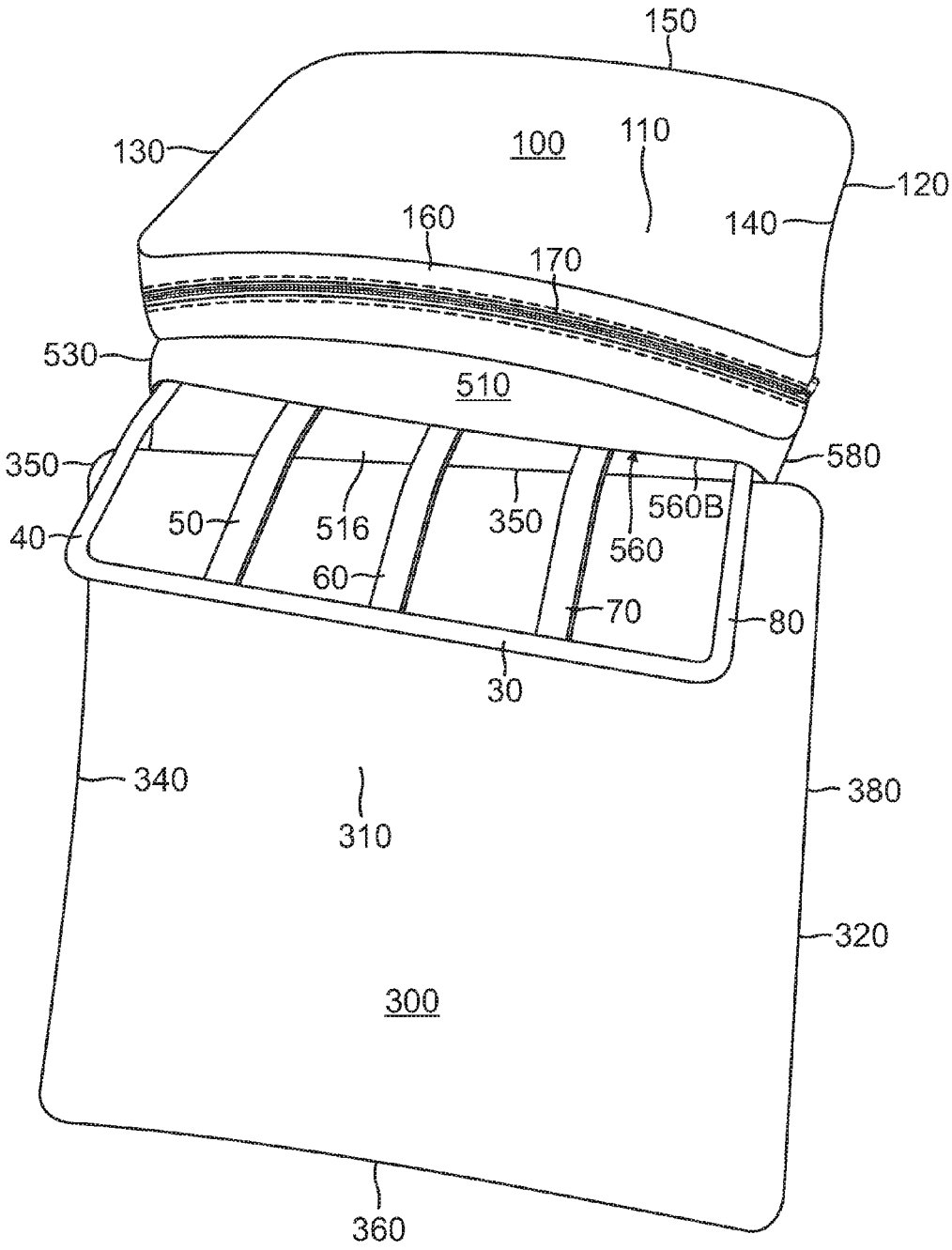
FIG. 2 is a top front perspective view of the back cushion affixed to the seat cushion with an opening in the connecting flap to receive the support member into the rear of the back cushion.

Referring to FIG. 2, there is illustrated an open front perspective view of the back cushion and the seat cushion with the back cushion rotated away from the seat cushion to expose the interconnecting flap. The back cushion is numbered 100 and the seat cushion is numbered 300 and the interconnecting flap is numbered 500 (see FIG. 3). The back cushion has a front surface 110 and a rear surface 120 (which is better illustrated in the cross sectional views of FIGS. 4A and 4B). The rear or back cushion 100 also has a left side surface 130, a right side surface 140, a top surface 150, a bottom surface 160, and has an opening 160-O which has a closing member such as a zipper 170.

Figure 3:
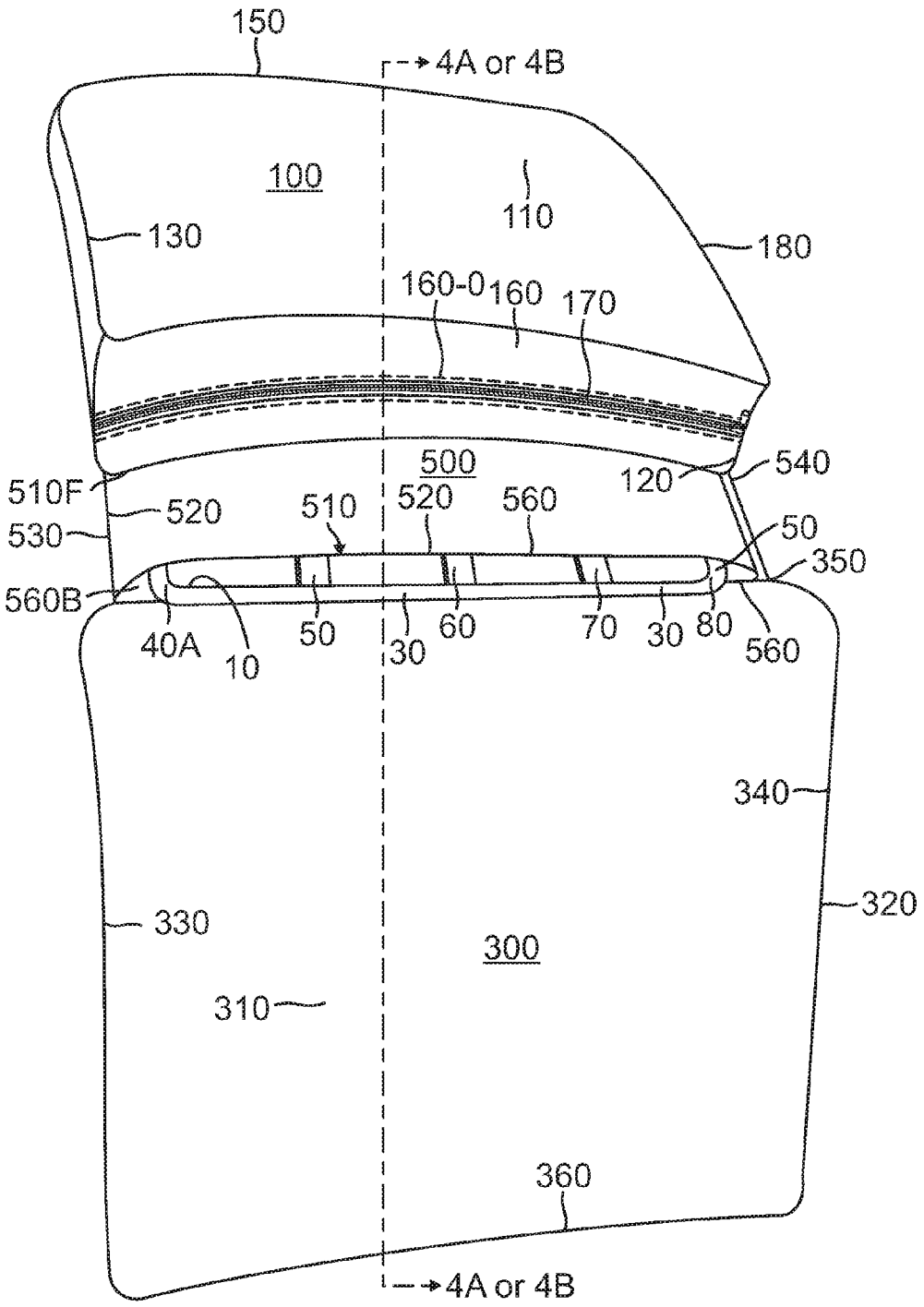
FIG. 3 is a top perspective view of the completed assembly where the steel support frame is fully inserted into the back cushion and the back cushion and seat cushion are retained together with the flap member with FIG. 3 illustrating the very lowest portion of the steel support extending through the flap member and into a portion of the back cushion.

Referring to FIGS. 2 and 3, the present invention's left side frame member 40 is illustrated being partially inserted into a bottom opening 560B which is aligned with a corresponding cushion opening. Also, illustrated is a seat cushion 300 having a left sidewall 340 a right sidewall 320, a top wall 350, a bottom wall 360 which seat cushion 300 is affixed to the back cushion 100 by interconnecting flap 500. The view in FIG. 3 illustrates the present invention back support member 10 inserted through the opening 560-B in the interconnecting flap 500 with the support member completely inserted so that only the bottom frame 30 and portions of the left side frame member 40 and right side frame member 80 and intermediate support ribs 50, 60, and 70 being illustrated.

Figure 4A:
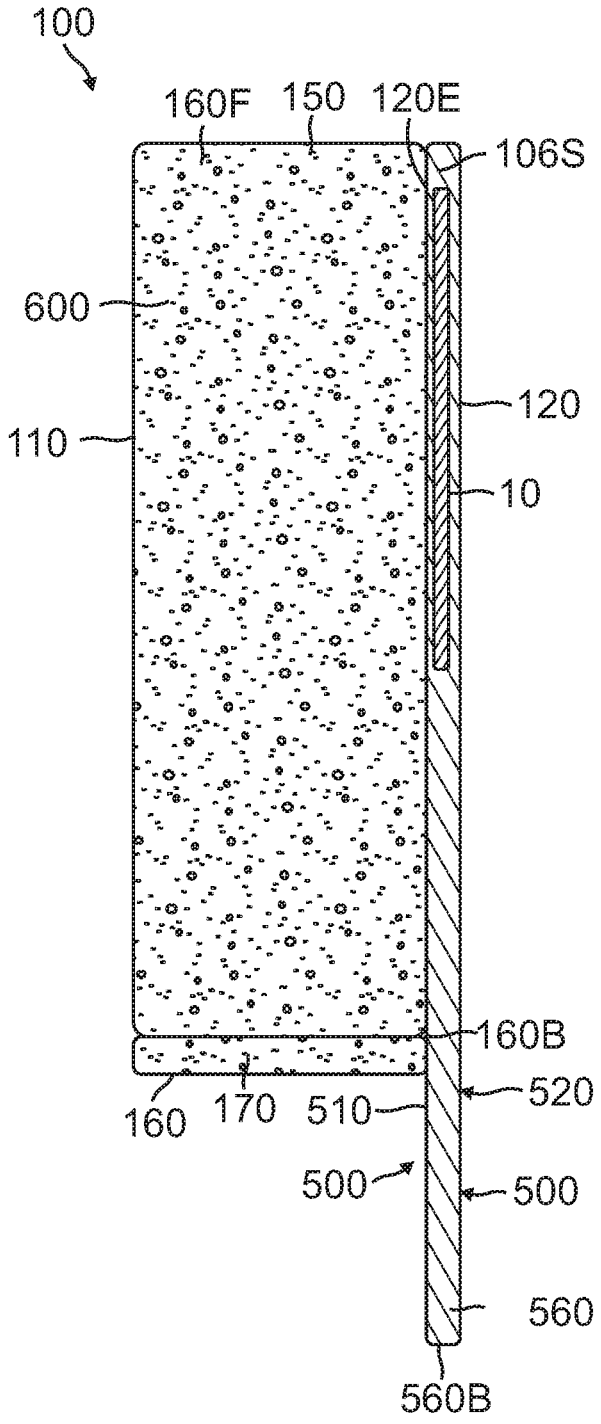
FIG. 4A is a cross-sectional view taken along Line 4A-4A of FIG. 3 illustrating one embodiment of the present invention where the back cushion has a first main chamber and a second support frame chamber with a dividing wall separating the two chambers so the present invention support frame does not come in contact with the foam.
Figure 4B:
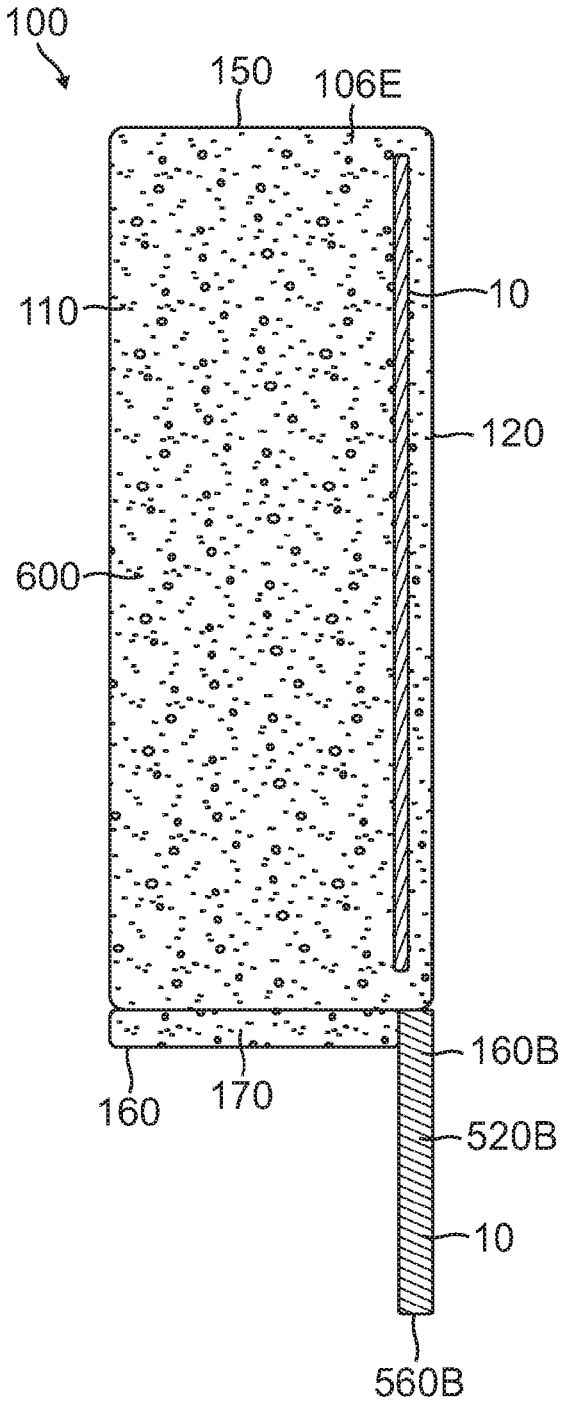
FIG. 4B is a cross-sectional view taken along Line 4B-4B of FIG. 3 wherein the cross section view is similar to the cross-sectional view of FIG. 4A but the dividing wall has been eliminated so the support frame member comes in contact with a portion of the foam.

Referring to FIGS. 2 and 3, FIG. 2 is a front perspective view of the back cushion 100 and seat cushion 300 connected by the interconnecting flap 500 illustrating the back support partially inserted through opening 560B and the interconnecting flap 500 and extending to an aligned opening as will be discussed in the cross section views of FIGS. 4A and 4B for back cushion 100. Referring to FIG. 2, there is illustrated a front surface 110, a rear surface 120, a left side surface 130, a right side surface, a top surface 150, and a bottom surface 160, and an opening 160-O which is sealed as a closing member such as a zipper 170. The interconnecting flap member 500 is illustrated in FIG. 2 has a front surface 510, a left surface 530, a right surface 580, a top surface 560, having an opening 560B through which the supporting frame 10 is inserted. The seat cushion 300 has a front surface 310, a left surface 340, a right surface 330, a back wall 350, a bottom surface 360. FIG. 3 is identical to FIG. 2 except that in FIG. 3 more of the steel support member 10 is exposed. Referring to the first variation illustrated in FIG. 4A, the back cushion 100 has a top surface 150 with an interior chamber divided into two separate chambers with a main or first chamber 160F and a rear or second chamber 106S separated by a dividing wall 120I. The cushioning member 600 is retained within the front chamber 160F and is sewn into a condition where it can only be opened from bottom opening 160B and zipper 170. Interconnecting flap 500 has a rear wall 520 and a front wall 510 where a small portion of the front wall 510 is affixed to a lower portion of the rear surface 120 of the back cushion 100 which is illustrated in FIG. 4B. The present invention back support 10 is a inserted through opening 560B in the bottom of the flap 500 which is aligned with opening 160B in second chamber 106S so that steel support member 10 is inserted through the opening 560B and aligned opening 160B. The dividing wall 120E separates the foam member 600 from support frame 10. FIG. 4B is identical to FIG. 4A except the interconnecting wall 120E has been eliminated and therefore the entire interior chamber is designated as 106E.

It will be appreciated that these are two alternative variations of the interior of the back cushion which either can have the present invention support member 10 having direct contact with the foam or to be separated by an interior dividing wall 120E.

Figure 5:
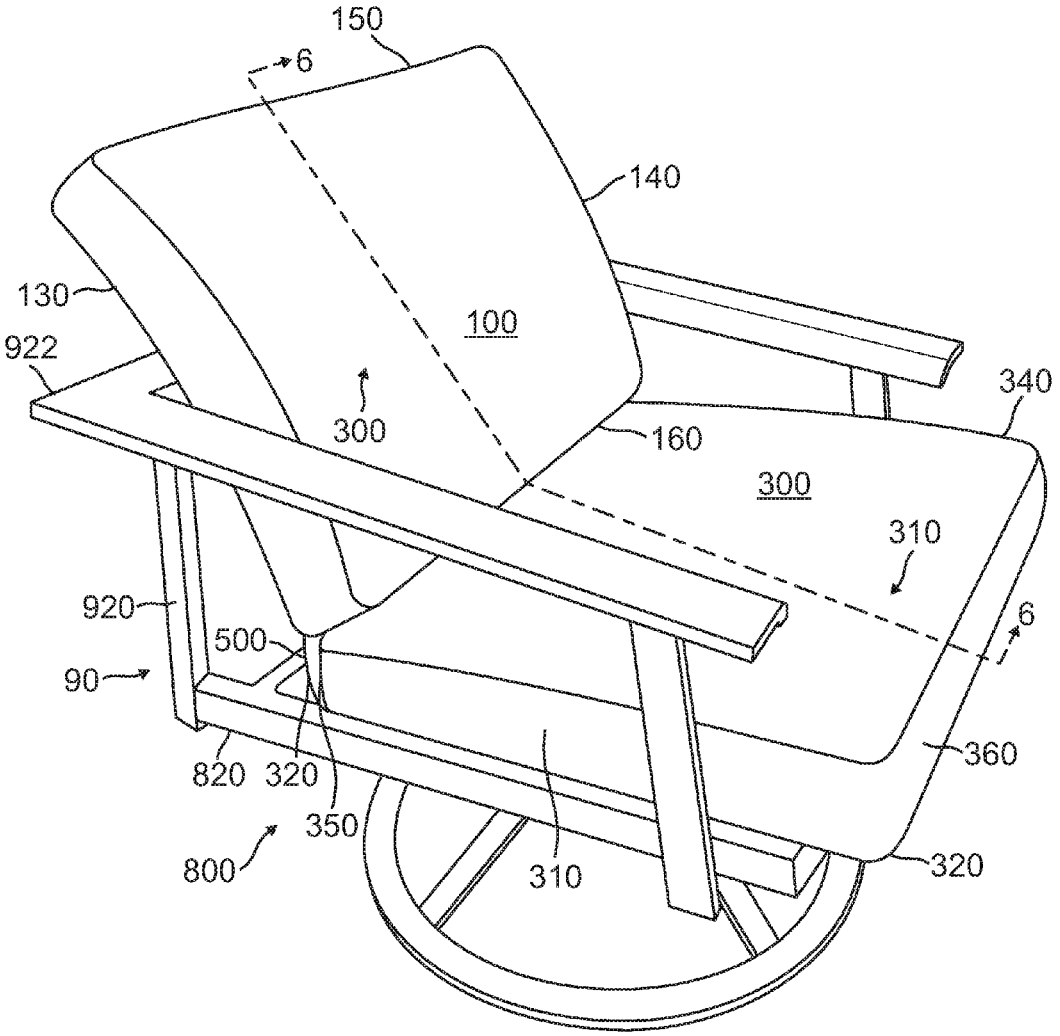
FIG. 5 is a perspective view of the present invention where the back cushion and the front cushion are retained on a chair.
Figure 6:
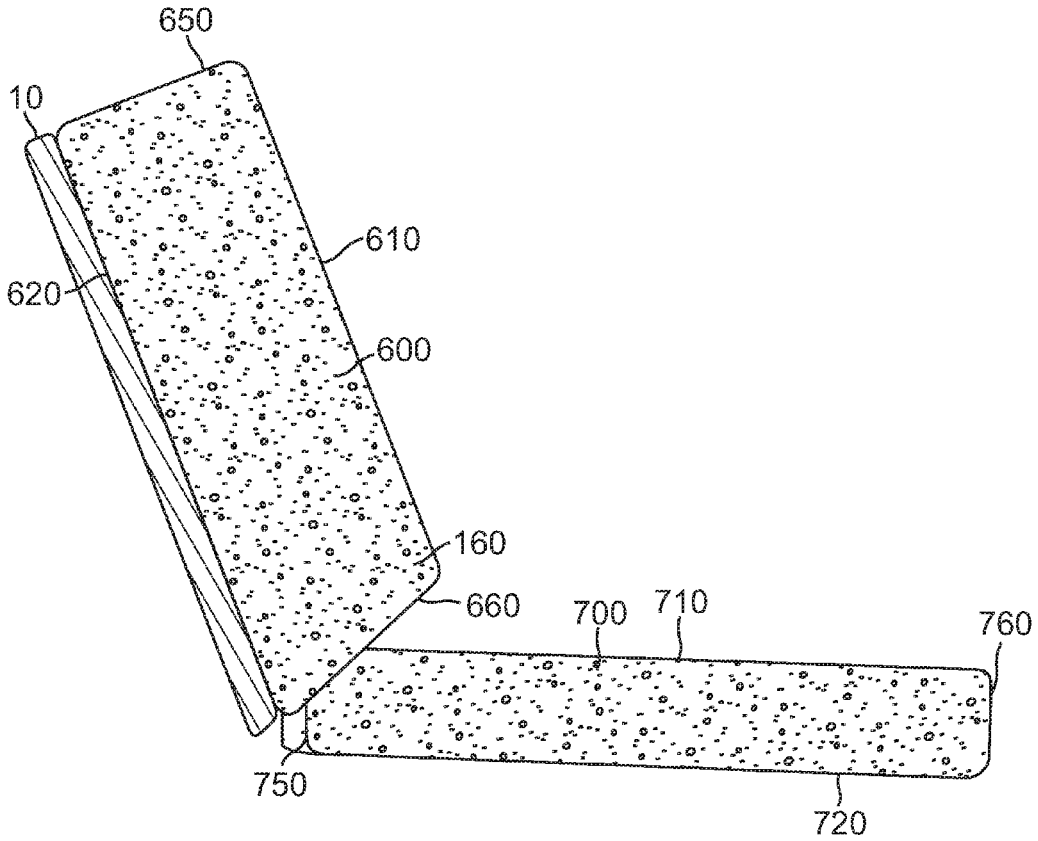
FIG. 6 is an interior cross-sectional view taken along line 6-6 of FIG. 5 illustrating the interior foam and present invention support against the of the foam, both in the back cushion and illustrating the foam interior of the seat cushion, the fabric covering of both the back cushion and seat cushion removed.

Referring to FIG. 5, there is illustrated a perspective view of the completed assembly of the back cushion 100 and seat cushion 300 connecting flap 500. The cushion is shown positioned on a chair. The chair can be of any design and style but has a seat section. The chair is numbered 800 with a back frame section 810 and a seat section 820 which can be of any design. The chair is designed so that the bottom cushion 300 rests against the seat section 820, the back cushion 100 rests against the back sections 920 and 922 and the flap member 500 is positioned between the back cushion 100 and seat cushion 300. This is also shown more clearly in the cross-section line of FIG. 6-6. FIG. 6 is a cross-sectional view taken along line 6-6 of FIG. 5.

Referring to FIGS. 5 and 6, when the assembly is in its operative condition, the seat cushion 300 is inserted onto the seat section 820 of chair 800 and the back cushion is inserted against seat back section 920 and 922 with connecting flap 500 adjoining the two in the rear and the support member 10 is concealed behind within and behind the foam 600 within the back cushion 100 and also concealed by the connecting flap 500. In order to remove the present invention support frame 10, the cushions 100 and 300 must be removed from the chair 800, the flap section 500 rotated to expose the openings in the flap section and the back section to remove the support frame 10.

FIG. 5 is a perspective view of the present invention where the back cushion 100 and the seat cushion 300 are retained on a chair.

FIG. 6 is an interior cross-sectional view taken along line 6-6 of FIG. 5 illustrating the interior foam 600 and present invention support frame 10 against the of the foam, both in the back cushion and illustrating the foam interior of the seat cushion, the fabric covering of both the back cushion and seat cushion removed.

Figure 7:
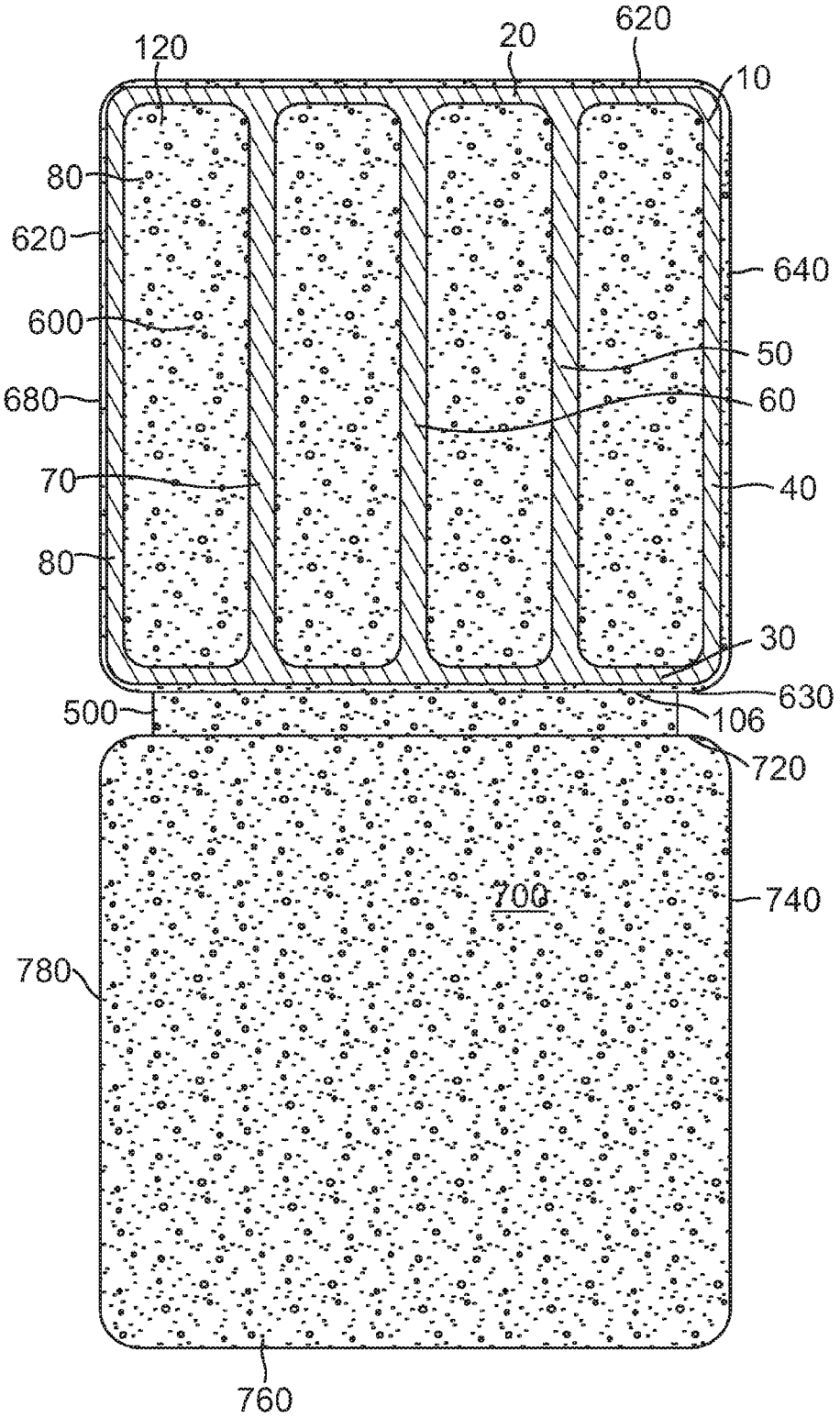
FIG. 7. is a rear interior view of the foam portions of both the back cushion and seat cushion with the present invention support frame against the back foam, the exterior covers removed.

FIG. 7 is a rear interior view of the foam portions of both the back cushion and seat cushion with the present invention support frame against 10 the back foam 600, the exterior covers removed. FIG. 7 illustrates the interior of the back cushion 100 and the seat cushion 300 connecting by the interconnect flap member 500 to illustrate how support member 10 is retained within the back cushion. In FIG. 7, there is no dividing wall shown however, it will be appreciated that the other variation as shown in FIG. 4A with a dividing wall is included in this invention. Back cushion 100 rests against all the sidewalls including the top wall 150, the left sidewall 140, the right sidewall 130, and the bottom wall 160. The exterior surfaces of the cushions have been eliminated in FIG. 7 to better illustrate the location of the support member 10 against the back of the foam 600 (illustrated without the covering of the back cushion 100). The support frame member has been flipped over in FIG. 7 relative to FIG. 1. The top frame member 20 is adjacent foam top 620. The bottom frame member 30 is against foam bottom 630. The left frame member 40 is adjacent left foam side 640. Right frame member 80 is against right foam side 680. Interior frame supporting ribs 50, 60 and 80 are against rear surface 620 of foam 690. Correspond foam surface of seat foam 700, namely top side 720, bottom side 730, left side 740 and right side 780 are also illustrated.

Therefore, through use of the present invention the seat cushion has an internal support which is concealed within the set cushion but can be removed for cleaning. The support member is in the rear interior chamber of the back cushion to provide support when someone leans against the back cushion 100 and against the front surface 110 and is fully supported by the support member 10 which can be made of any material such as steel, aluminum, polyurethane, polycarbonate etc. to provide substantial support to the individual when he or she rests his/her back against the back cushion.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A seat cushion adapted for use with a chair having at least a seat section and a back section, the seat cushion comprising:

a. a back cushion including an exterior cover having aligned exterior and interior surfaces including a front surface, a top surface, a bottom surface, a rear surface, a first side surface and a second side surface surrounding an interior chamber including an interior dividing wall separating the interior chamber into a first main chamber and a second chamber, the bottom surface having a first opening leading to the first main chamber, a foam insert retained within the first main chamber, the bottom surface having a second opening leading to the second chamber;

b. a seat cushion having aligned exterior and interior surfaces surrounding an interior chamber housing a second foam insert, the seat cushion having at least a top surface and a bottom surface;

c. a connecting flap having a back wall and a front wall, the connecting flap affixed to the exterior rear surface of the back cushion and affixed to the bottom surface of the seat cushion, the connecting flap having a connecting flap opening aligned with said second opening in the back cushion;

d. a support frame member including a top frame member, a bottom frame member, a first side frame member, a second side frame member and at least one internal support member extending from the top frame member to the bottom frame member, the support frame retained in said second chamber; and e. said back cushion and said seat cushion are separate from said chair, said seat cushion supported on said chair seat section, said back cushion supported on said seat back section, said support frame member concealed from view;

f. whereby, said support frame member is removably inserted into said second chamber through said aligned connecting flap opening and said second opening.

2. The seat cushion in accordance with claim 1, further comprising: said support frame member is made of material selected from the group consisting of steel, aluminum, stainless steel and polyvinyl.

3. The seat cushion in accordance with claim 1, further comprising: a closing zipper incorporated into said first opening.

4. A seat cushion adapted for use with a chair having at least a seat section and a back section, the seat cushion comprising:

a. a back cushion including an exterior cover having aligned exterior and interior surfaces including a front surface, a top surface, a bottom surface, a rear surface, a first side surface and a second side surface surrounding an interior chamber having a first main chamber and a second chamber, the bottom surface having a first opening leading to the first main chamber, a foam insert retained within the first main chamber, the bottom surface having a second opening leading to the second chamber;

b. a seat cushion having aligned exterior and interior surfaces surrounding an interior chamber housing a second foam insert, the seat cushion having at least a top surface and a bottom surface;

c. a connecting flap having a back wall and a front wall, the connecting flap affixed to the exterior rear surface of the back cushion and affixed to the bottom surface of the seat cushion, the connecting flap having a connecting flap opening aligned with said second opening in the back cushion;

d. a support frame member including a top frame member, a bottom frame member, a first side frame member, a second side frame member and at least one internal support member extending from the top frame member to the bottom frame member, the support frame retained in said second chamber; and e. said back cushion and said seat cushion are separate from said chair, said seat cushion supported on said chair seat section, said back cushion supported on said seat back section, said support frame member concealed from view;

f. whereby, said support frame member is removably inserted into said second chamber through said aligned connecting flap opening and said second opening.

5. The seat cushion in accordance with claim 4, further comprising: said support frame member is made of material selected from the group consisting of steel, aluminum, stainless steel and polyvinyl.

6. The seat cushion in accordance with claim 4, further comprising: a closing zipper incorporated into said first opening.

7. The seat cushion in accordance with claim 4, further comprising: a dividing wall separating the first main chamber from the second chamber.

* * * * *